United States Patent [19]

Rome

[11] 4,431,038

[45] Feb. 14, 1984

[54] ACTUATING HOLDER FOR COMBINED ELECTRIC ERASER-PENCIL SHARPENERS

[76] Inventor: Philip L. Rome, 1058 Baseline Rd., Claremont, Calif. 91711

[21] Appl. No.: 240,786

[22] Filed: Mar. 5, 1981

[51] Int. Cl.[3] ..... B43L 23/02

[52] U.S. Cl. ..... 144/28.1; 248/314; 200/61.59

[58] Field of Search ..... 144/28.5, 28.4, 28.72, 144/28.1, 28.11; 310/50; 248/314; 200/51 R, 61.59, 61.58 R

[56] References Cited

U.S. PATENT DOCUMENTS

| | | | |
|---|---|---|---|
| 2,729,080 | 1/1956 | Bennett | 248/314 |
| 2,767,686 | 10/1956 | Goumaz | 120/1 |
| 3,090,358 | 5/1963 | Condon | 120/96 |
| 3,179,255 | 4/1965 | DeCaccia | 248/314 |
| 3,267,254 | 8/1966 | Weller et al. | 248/314 |
| 3,273,846 | 9/1966 | DeMare | 248/314 |
| 3,467,843 | 9/1969 | Dailey | 310/50 |
| 3,595,285 | 7/1971 | Ruben | 144/28.5 |
| 3,776,286 | 12/1973 | Blanck | 144/28.5 |
| 4,050,487 | 9/1977 | Mabuchi et al. | 144/28.5 |

FOREIGN PATENT DOCUMENTS

| | | | |
|---|---|---|---|
| 256169 | 12/1964 | Australia | 248/314 |
| 2042326 | 9/1980 | United Kingdom | 248/314 |

*Primary Examiner*—W. D. Bray
*Attorney, Agent, or Firm*—Leo R. Carroll

[57] ABSTRACT

A holder for a combined electric eraser-pencil sharpener which causes the sharpener to be actuated upon insertion of the pencil. A using draftsperson thus obtains the benefits of a separate fixed sharpener and avoids picking up and using the hand-held combined eraser-sharpener. The holding device comprises an open-ended cup structure containing a supporting spring. As the electric eraser-pencil sharpener being supported is moved under pencil insertion forces, switch actuation means activate the sharpener by depressing the motor switch.

3 Claims, 4 Drawing Figures

ACTUATING HOLDER FOR COMBINED ELECTRIC ERASER-PENCIL SHARPENERS

BACKGROUND OF THE INVENTION

The present invention generally pertains to holders for electric pencil sharpeners, and is particularly directed to a support which can be adapted to a combined eraser-pencil pointer and provide self-actuation of the sharpener upon pencil insertion.

The prior art discloses many power operated sharpeners to be used with either wood-encased pencil types or mechanically held drawing leads. Such devices can be actuated by pressure closure of an external switch, as in R. S. Condon, U.S. Pat. No. 3,090,358 for Sharpening Device For Pencil Leads; or by pressure closure of an internal switch as in K. Mabuchi and Y. Tsuchimochi, U.S. Pat. No. 4,050,487, for Electric Sharpener.

Cost and space savings have been obtained through combination devices in which a sharpener is mounted on one end of a powered eraser. J. Goumaz, U.S. Pat. No. 2,767,686 for Pencil Lead Pointer, describes a draftspersons lead pointing device which can be utilized with a conventional electric erasing machine. The lead pointer is adapted to either the shaft end opposite the electric eraser, or to replacement of the erasing tip.

Since by nature the erasing machines are portable, the sharpener in such combination devices is used after first picking up the device. The flexible nature of a hand held support can result in erratic less precise sharpening. The extra lifting and replacement operational steps are also time consuming.

SUMMARY OF THE INVENTION

It is therefore, a primary object of the present invention to provide a novel holder for a combination eraser-pencil pointer that allows sharpening without the time consuming operation of picking up the device.

Another object of the invention is to provide a holder which adds a one-handed self-actuating feature to existing combination eraser-pointers without modification.

It is a further object of the invention to provide a holder with a solid sharpening support which will reduce the inaccuracies associated with a hand-held flexible support.

It is a still further object of the invention to provide a simple inexpensive holder which can provide storage of the combined eraser-pencil pointer at a location convenient to the draftsperson.

The present invention is directed to a holder for a combined electric eraser-pencil pointer which will provide self-actuation upon pencil inserted in addition to support for the device. It will thus permit lead sharpening without removal of the combined eraser-pointer from the holder.

The combined device is flexibly supported in the holder, with switch actuation means in close physical proximity to the external electrical switch on the body of the device. The mounting is such that the small pressure exerted by pencil insertion will move the device sufficiently to cause the switch to be activated. Bottoming out of the device maintains the switch closed and provides a rigid support. This inexpensive holder thus adds a self-actuation feature to conventional manually operated combined eraser-pointers without modification.

Other objects and advantages of the present invention will become more readily apparent upon having reference to the accompanying drawings and the following description.

DESCRIPTION OF PREFERRED EMBODIMENTS

Figure 1:
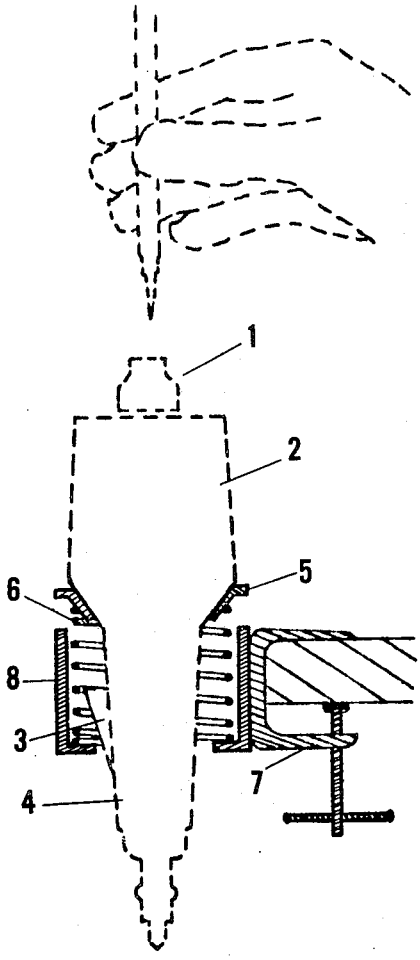
FIG. 1 is a side cross section view showing the relationship of the holder mounted on a drafting table with the unactivated eraser pencil sharpener shown in phantom.

Referring to FIG. 1, there is shown in phantom the combined eraser-pointer device 2 to be supported, in an unactivated supported relationship with the holder 8. Device 2 contains a pencil pointing insertion end 1, a tapered eraser barrel 4, and a tapered trigger type electric switch 3.

Holder 8 is a cup shaped structure, made of a suitable rigid metal or plastic material. The bottom opening of holder 8 has a smaller diameter than that of the open top. Rigidly attached to holder 8 are suitable means of attaching the holder 8 to a draftsperson's board or desk. For purposes of illustration, the fastening method shown consists of an adjustable C clamp 7.

Within holder 8, compression spring 6 rests on and is attached to the bottom lip created by the smaller bottom hole in holder 8. Attached to the upper end of spring 6 is collar 5, which receives the weight of the device 2 when supported.

Figure 4:
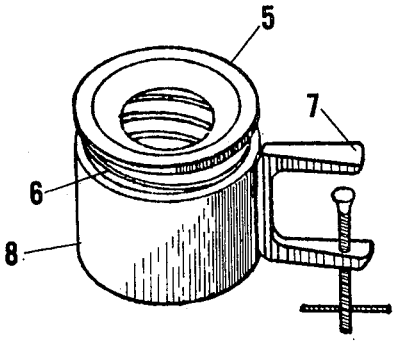
FIG. 4 is a top perspective view looking downward on the empty holder.

FIG. 4 shows an isometric view of holder 8 looking down on collar 5.

Figure 2:
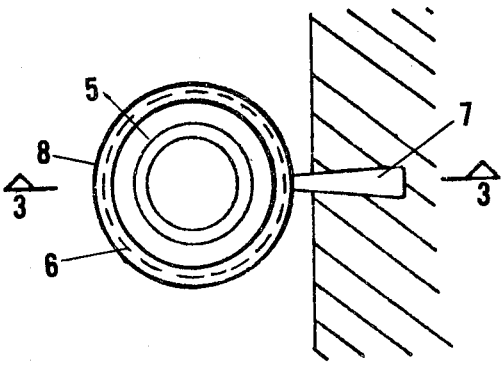
FIG. 2 is a top plan view of the holder.

FIG. 2 shows the relative diameters of the collar 5 and the base opening in holder 8. The diameter of this bottom hole is approximately equal to the diameter of tapered eraser barrel 4 at the axial location of trigger switch 3.

The inner diameter of collar 5 is such as to permit passage of the trigger switch 3 and thus allow support to device 2 on its body above the switch 3 location.

Figure 3:
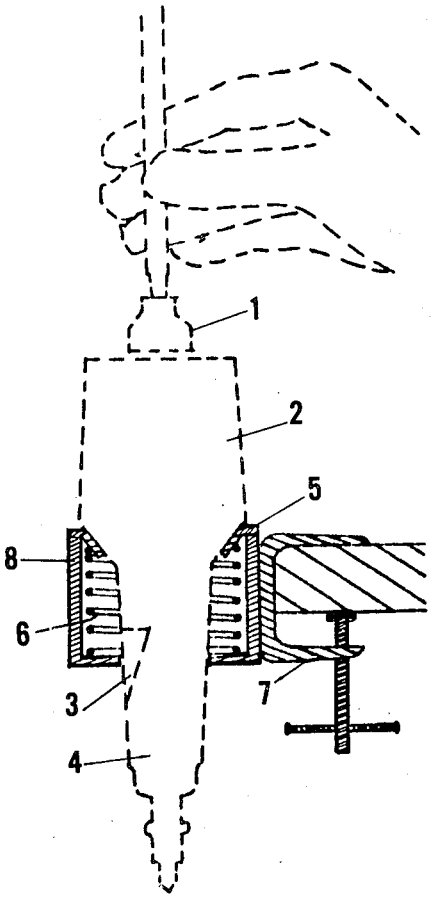
FIG. 3 is a vertical section through the holder taken along line 3—3 of FIG. 2, showing the positioning of the holder and the phantomed activated eraser pencil sharpener when under pencil insertion conditions.

FIG. 3 shows a section of the holder 8 with the combined eraser-pointer device 2 being supported by the holder with trigger switch 3 in its closed, or actuated position. When a pencil to be pointed is inserted in end 1, device 2 with its tapered barrel 4 will move downward through the bottom opening in holder 8. Switch 3 will be depressed by said opening and the device motor will be actuated. At this point the support will become rigid since barrel 4 and switch 3 will have bottomed out on the lip of the bottom hole in holder 8.

It is to be understood that the foregoing description is merely illustrative of the preferred embodiment of the invention and that the scope of the invention is not to be limited thereto, but is to be determined by the scope of the appended claims.

What I claim is:

1. A self actuating holder for supporting a type of combined electric eraser-pencil sharpener with a motor actuation trigger switch mounted on one side of a tapered cross section body, said holder comprising:

a collar having a tapered bore with a lower minimum diameter which is greater than that required to permit passage of the combined eraser pencil sharpener to be supported without compression of said combined sharpener's side mounted actuation trigger switch, said lower minimum diameter being also less than the largest diameter of the tapered body of said combined sharpener to be supported, whereby said combined sharpener can be circumferentially contacted and supported at the axial position on its tapered body which is the position above said switch at which said sharpener's tapered external diameter becomes larger than said collar bore;

a cup shaped base structure having a top opening and a lesser bottom opening, said bottom opening having a diameter less than the diameter of said combined eraser-pencil sharpener's tapered body when measured at the axial position of the top of said actuation switch, and greater than the diameter of said sharpener's tapered body when measured at the axial position of the bottom of said actuation switch, whereby said combined sharpener cannot be passed through said bottom opening without said side mounted external trigger switch being fully actuated by compression; and a helical coil spring with a constant external diameter less than said top opening in said cup shaped base structure, said spring having an upper end internal diameter greater than said collar bore minimum external diameter and a lower end internal diameter greater than said base structure bottom opening diameter, said spring positioned within said cup shaped base between said collar and said base bottom opening so that said eraser pencil sharpener can be normally supported with its side mounted actuation switch positioned unactivated above said bottom opening until downward pressure from insertion of a pencil in said sharpener moves said switch downward against said spring until said switch is compression activated by closure within said base bottom opening.

2. In a holder for a combined eraser-pencil sharpener as recited in claim 1, further including means for attaching said holder to the surface of a drawing board.

3. In a holder for a combined eraser pencil sharpener as recited in claim 2, wherein said attachment means is an adjustable clamp.

* * * * *